United States Patent [19]

Knebel et al.

[11] Patent Number: 4,616,536

[45] Date of Patent: Oct. 14, 1986

[54] WRENCH

[75] Inventors: Fritz Knebel, Limburgerhof; Rudolf Dassel, Gevelsberg, both of Fed. Rep. of Germany

[73] Assignee: Beler-Dowiday GmbH Werkzeug-Union, Fed. Rep. of Germany

[21] Appl. No.: 806,978

[22] Filed: Dec. 9, 1985

[30] Foreign Application Priority Data

Dec. 7, 1984 [DE] Fed. Rep. of Germany ..... 3444725

[51] Int. Cl.[4] ..... B25B 13/18

[52] U.S. Cl. ..... 81/128; 81/355

[58] Field of Search ..... 81/129, 126, 128, 150, 81/151, 154, 355

[56] References Cited

U.S. PATENT DOCUMENTS 3,141,363 7/1964 Ferry ..... 81/128

3,358,533 12/1967 Wren ..... 81/128

*Primary Examiner*—James G. Smith

*Assistant Examiner*—Maurina Rachuba

*Attorney, Agent, or Firm*—Diller, Ramik & Wight

[57] ABSTRACT

The wrench comprise two levers (10,21). A jaw (15) is fixed to the one lever (10) on which a slider (17) is displaceable to adjust the mouth width. The second lever (21) is disposed at the slider (17) by means of a hinge (23). The second jaw (25) is tiltably mounted at the lever (21) by means of a hinge (24), the tilting movements being limited by two stops (26 and 27). At least one stop (27) is provided at a sliding element (29) which, responsive to the position of the second lever (21) is adapted to recede to permit, with an empty return movement of the pipe tongs a stronger tilting movement of the second jaw (25).

11 Claims, 5 Drawing Figures

WRENCH

Figure 1:
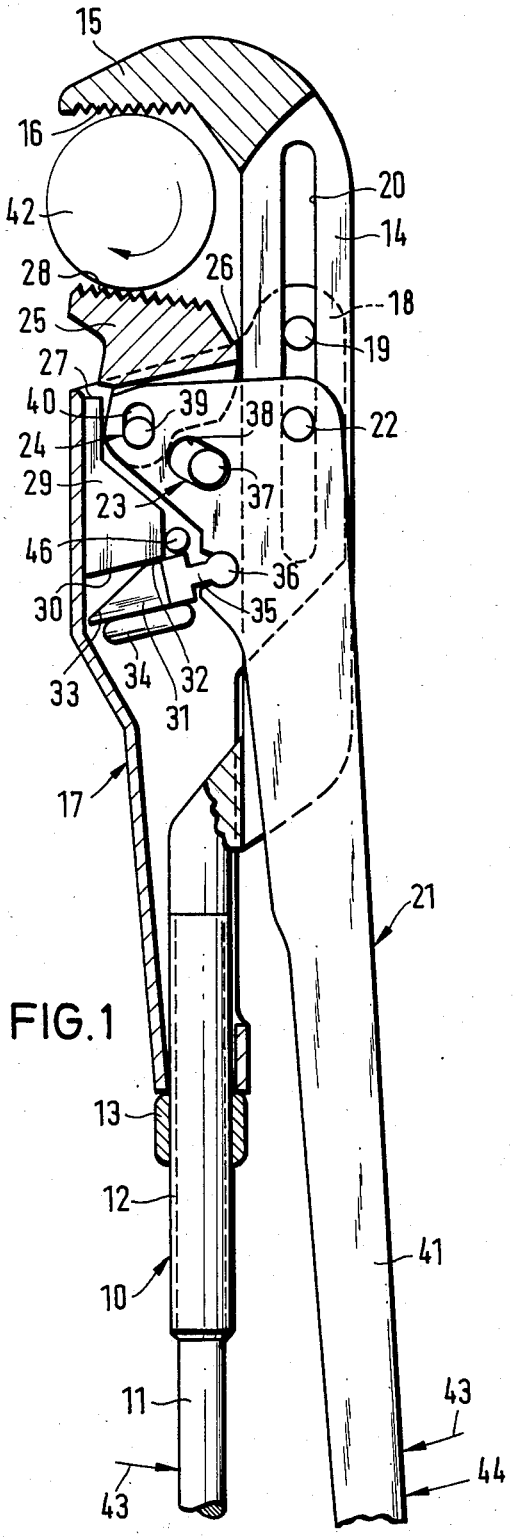

The invention relates to pipe tongs comprising a first jaw fixed to a first lever, a second lever swivable relative to the first lever and supporting a pivotally mounted second jaw, a slider connected through a hinge to the second lever and adjustable along the first lever to change the mouth width of the jaws, and two stops limiting the swivel movement of the second jaw towards the first lever and in counter-direction.

Wrench such as known from German Patent No. 27 28 454 and German Utility Model No. 78 24 721 are used to turn pipes, screws and other articles. In operative condition, both levers are manually compressed thus allowing the jaws to firmly encompass the object. In the condition of return movement, both levers are swivelled oppositely without being firmly pressed together. To permit to apply force by the pipe tongs in both senses of rotation, the second jaw is mounted to swivel at the slider so that, responsive to the desired rotational direction, it either abuts against a stop of the first lever or against an opposite stop of the slider. Half of the gripping faces of the two jaws is inclined towards the one side, half of them to the other side. While the rotation of the object in different directions and an idle return movement may be performed with the known pipe tongs, it is necessary to strictly pay heed that the right halves the gripping faces of the two jaws of the pipe tongs are applied to the article. In the negative, there is the risk for the movable jaw to change direction and to adjoin the opposite stop. As a result theof, the wrench slip without effectively turning the object of interest. Further, by unintended swivel movements of the movable jaw, injuries may occur due to the resultant jerks.

As another disadvantage of the above mentioned pipe tongs, the second lever, in case of the return movement of the tongs must be swivelled far off the first lever if the contour of the object to be turned is unround, e.g. hexagonal. If so, the second jaw abuts during the return movement against the associated stop and the larger opening movement of the tongs is transferred to the second lever whose handle forms the effort arm of this lever and must be widely swivelled opened accordingly. This is quite unsatisfactory for the manipulation and, frequently, for the space requirements of the tongs.

It is the object of the invention to provide pipe tongs of the above mentioned type which, for the return movement allow to open the jaws more widely while the swivel movement of the second lever is reduced.

To solve the stated problem, the invention provides that at least one of the stops consists of a slide member guided at the slider and adapted to be locked in one working position by a locking element controlled by the movement of the second lever, and allowing the slide member to recede when the second lever is swung out.

Thus, the stop formed by one end of the slide member is changeable responsive to the swivel position of the second lever relative to the first lever. If the second lever is swivelled out, the slide member is pressed back by the movable jaw, while the original stop position is cancelled thus permitting to displace the slide member farther than normally in the operative position. Due to said greater swivel of the second jaw, the effective mouth width is enlarged so that for the idle return movement of the wrench, the second lever must be swivelled much less than in case of a stationary stop.

The second jaw of the pipe tongs of the invention has a gripping surface formed by teeth and being of a flat design. In a position in which the second jaw abuts against the stop of the first lever, said gripping face is inclined in one direction at an acute angle relative to the flat gripping face of the stationary jaw. If said second jaw is in its other stop position, its gripping face is inclined at an acute angle in the counter-direction to the gripping face of ths stationary jaw. Only in the central position of the swivel path of the second jaw, both gripping faces extend in parallel to each other. However, said central position is not stable because the second jaw does not rest against one of the stops. The stable position corresponding to the direction in which the object clamped between the jaws is rotated with force is automatically set, while the second jaw may not tilt unintendedly.

Preferably, the locking element is connected to the second lever via at least one articulated arm causing the entrainment of the locking element when the second lever is swivelled up.

Joined to a locking face extending substantially in parallel to the rear face of the slide member, the locking element may be provided with an oblique slide face. If the second lever is swivelled out, the slide member presses against the slide face. As soon as the second jaw abuts against the slide element, the latter yields, and the second jaw may perform a swivel movement superior to that which is possible in the operative position of the two levers. As a result, the return movement with a larger opening is facilitated.

The locking element which is guided by a guide member of the slider is backed against the pressure of the slide element which only has a control function while the force is received by the guide member forming an integral part of the slider whose position determines the mouth width of the wrench.

The invention will be now explained hereunder in more detail with reference to the drawings.

Figure 2:
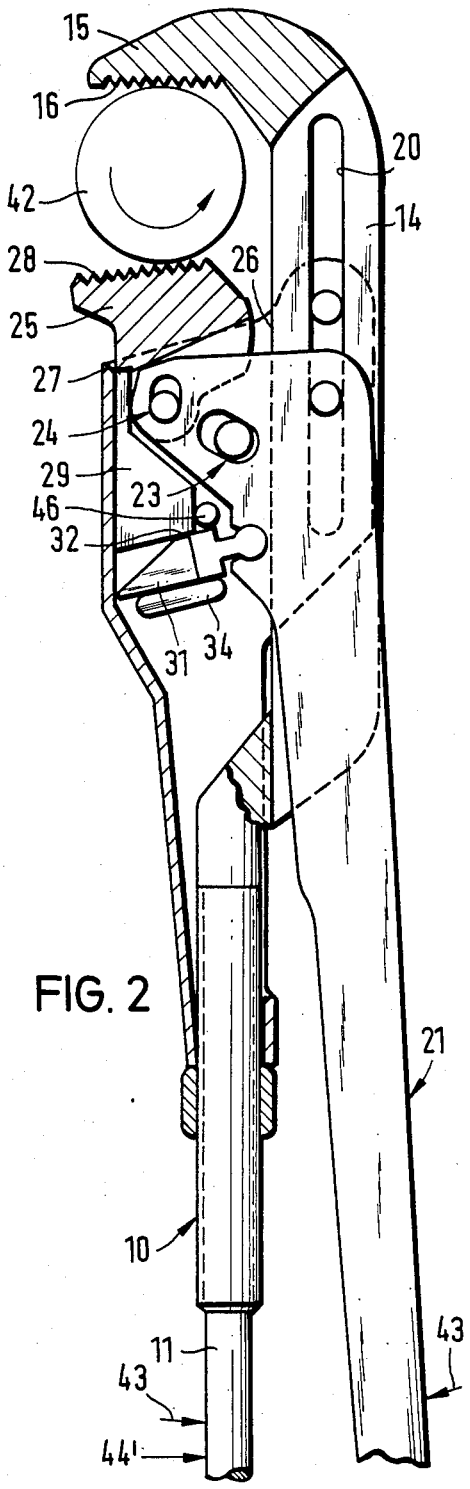
Figures 3, 4:
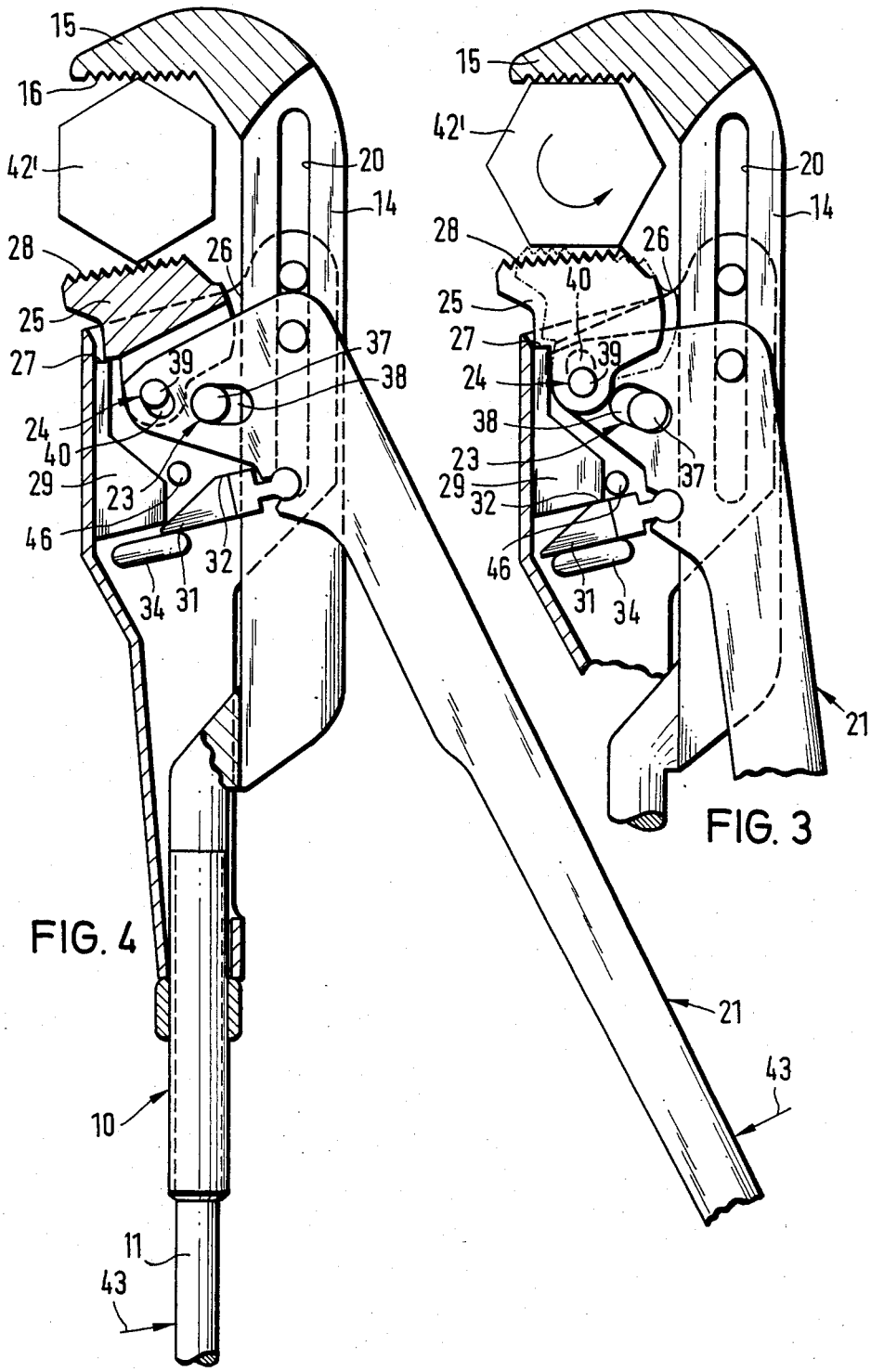
Figure 5:
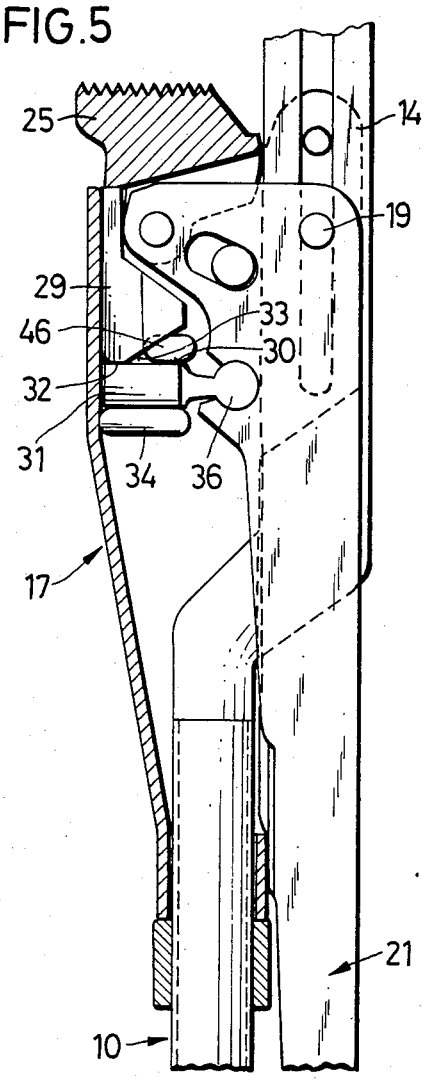

FIG. 1 is a side view, partly (broken away, of the tongs, if rotating an article in clockwise direction, FIG. 2 shows the wrench, if rotating an article anticlockwise, FIG. 3 shows a wrench, if rotating a hexagonal head, FIG. 4 is a view of the opening position of the wrench during the return movement over the heaxagonal head, and FIG. 5 is a fragmentary elevational view of a second embodiment of the pipe.

The illustrated wrench comprise a first lever or arm 10 having a handle 11 at its lower end, the handle 11 being adjoined by a thread portion 12 on which a nut 13 is seated. The handle 11 and the thread portion 12 are made from a round bar, at the upper end of which a plate 14 is laterally fixed to elongate the round bar whose axis, however, is offset laterally relative to that of the round bar. From the upper end of plate 14, the the stationary jaw 15 projects laterally, its working surface 16 extending rectangularly to the handle 11. The working surface 16 is provided with teeth the tips of which are situated in one common plane.

Nut 13 forms a support for the slider 17 of a sleeve-type design which contains a slot for the passage of the lower end of plate 14. The sleeve-type design or sleeve portion (unnumbered) of the slider 17 serves as the means for movably connecting the slider 17 to the first arm 10. A projection 18 extending laterally from the slider 17 is provided with a bolt 19 protruding through a slot 20 of plate 14, the bolt 19 having the duty of guiding relative to the lever 10 said slider 17 whose lower end is supported by the nut 13 thus allowing the slider to be displaced longitudinally along said lever.

The second lever or arm 21 is also provided with articulate connecting means including a bolt 22 which is guided in the slot 20 of the first lever 10, the second lever 21 being connected via the hinge or articulate connecting means 23 to the slider 17 thus enabling the lever 21 to pivot around the hinge 23 relative to the slider 17. Another hinge or pivotal connecting means 24 provided at the side of and above the hinge 23 is responsible for the connection of the second jaw 25 to the second lever 21, the second jaw 25 being adapted to swivel around the hinge 24, in one direction, as far as to stop or stop means 26 which is formed by plate 14 of the first lever 10, and in the counter-direction as far as to stop or stop means 27 which will be still explained hereunder.

The uniformly toothed working surface 28 of the jaw 25 is flat. If the jaw 25 abuts against the stop 26, such as shown in FIG. 1, its working surface 28 forms an acute angle with the working surface 16 of the other jaw 15. If the jaw 25 abuts against the other stop 27, the two stated working surfaces also form an acute angle, which, however, points to the opposite side. In other words, the working surface 28 may oscillate about its parallel position relative to the working surface 16.

Stop 27 is disposed at the upper end of the sliding member 29 housed displaceably inside slider 17 and being guided approximately in parallel to the handle 11 and between the wall of the slider 17 and a cross pin 46 of said slider. Said cross pin 46 also serves for guiding the locking element 31 and it thus performs a double duty. At the sliding member end averted from the stop 27, a support surface 30 abuts against the locking element 31 which is provided with a locking face 32 extending in parallel to the support surface 30 and with a sliding or camming surface 33 extending at an acute angle relative to the support or cam follower surface 30, the locking element 31 being supported by a guide member 34 which is firmly fixed at the slider 17. Said locking element 31 is arranged between the guide member or support surface 34 and the slide element 29 and it is displaceable in parallel to the support surface 30. Said displacement is performed via the articulated arm 35 through which the locking element 31 is connected to the second lever 21, the end of the articulated arm 35 having a spherical part or connecting means 36 pivotally supported in a corresponding recess of the lever 21.

The hinge 23 by which the second lever arm 21 is supported at the slider 17 consists of a link pin 37 fixed at the slider 17 and of an elongated hole 38 of the second lever arm 21, the elongated hole 38, as illustrated in FIG. 1, preferably extending towards the hinge 24 and at an upward inclination. Hinge 24 consists of a pin 39 fixed at the jaw 25 and displaceable in an elongated hole 40 of the second lever arm 21. The orientation of the elongated hole 40 is more or less transverse to the direction of the two working surfaces 16 and 28.

One lever arm of lever 21 is formed by the handle 21, the other lever arm being determined by the distance between the hinges 23 and 24. Accordingly, lever 21 is of the double arm-type, and, due to the great lever arm ratio, a high increase in force is caused.

The mouth width of the pipe wrench is adjusted by the nut 13 on the thread portion 12. As a result, the slider 17 moves along the first lever 10, the second lever 21 being entrained simultaneously and pins 19 and 22 are guided in the slot 20.

The operation of the wrench is as follows hereunder.

FIG. 1 shows the condition in which a cylindrical object 42 clamped between the jaws 15 and 25 may be rotated clockwise. To this effect, nut 13 is so adjusted that, with a later compression of the levers 10 and 21 in the direction of arrows 43, the object 42 is held between the jaws 15 and 25 while levers 10 and 21 are not pressed apart under the pressure exerted by the object 42. During the closing movement of the tongs levers, the sliding member 29 is pressed upwardly by the inclined face 33 of the locking element 31 until the locking surface 32 rests against the support face 30. Due to the pressure exerted on the slide member 29 by the swivable jaw 25, there is caused a friction between the faces 30 and 32 to prevent the tongs levers 10 and 21 from being spread apart again under the pressure of the object 42. Upon its closure, the pipe tongs are swivelled by pressure against the lever 21 in direction of arrow 44 so as to forcefully rotate the object 42. It is not necessary to maintain the closing force in direction of arrows 43 because, for the reasons stated above, the tongs will not be opened automatically. During the rotational movement, the hinge pin 39 rests against the lower end of the elongated hole 40. Jaw 25 is tilted against the stop 26 situated rearwardly in the sense of rotation, while stop 27 is free. To return the pipe tongs, levers 10 and 21 are pressed apart, the tongs are opened and the self-clamping condition is cancelled. With the return movement, the jaw 25 tilts against stop 27, and the object 42 is not entrained. When reseizing the object, the toothed faces of the two opposite clamping jaws should never abut simultaneously against the pipe to be rotated because the swivel movement of the tongs on said pipe would immediately be stopped by locking.

In the drawings, the distance between the stop 27 of the slide member 29 and the respective counterface of the jaw 25 is scaled up for a clearer information. Said faces press already against one another when the jaw 25 is in the (unstable) central position, and when the tongs levers are closed. Together with locking element 31, the slide member 29 forms a friction unit preventing the levers 10, 21 from being spread apart under the pressure of the object 42.

FIG. 2 shows the condition in which the object 42 is turned anticlockwise. If so, the levers 10 and 21 are compressed in the direction indicated by arrows 43, thus causing the tongs to be closed. On lever 10, force is manually now applied in direction of arrow 44'. Jaw 25 tilts against the stop 27. For the empty return movement, the levers are pressed apart contrary to the direction of arrows 43 thus causing a slight swivel of lever 21. The jaw 25 is relieved. It swivels against the stop 26 and the working faces 16 and 28 release the object 42.

If a screw head 42' is rotated in the manner illustrated in FIG. 3, the working phase in which the screw head 42' is to be turned is ruled by the conditions as disclosed in connection with FIGS. 1 and 2. Two opposite flat sides of the screw head 42' are engaged by the working faces 16 and 28. The condition of the jaw 25 during which the screw head 42' is turned anticlockwise is shown with full lines, while the situation taken by the jaw 25 with a clockwise rotation of the screw head is dot-lined.

If the wrench at the screw head 42' are turned back, its mouth width must be temporarily enlarged as far as to the external circle of the screw head.

This is shown in FIG. 4. When the lever 21 is swivelled out, it entrains with the articulated arm 35 the locking element 31. Said support surface 30 of the slide member 29 is released by the locking face 32 so that it may recede as far as to the guide member 34. At the same time, the position of stop 27 is changed thus allowing an increased lowering and swivelling of the jaw 25.

Due to said increased lowering and inclination of jaw 25, it is easier for the tongs to move beyond the deadpoint of the swivel movement about the edge of the screw head 42. Sufficient liberty for the swivel movement is granted to the jaw 25 by the elongated holes 28 and 40. If such liberty does not exist, jammings may occur easily.

The embodiment of FIG. 5 is different from that of FIGS. 1 to 4 in that the inclined face 33 and the locking face 31 are provided at the lower end of the slide member 29 while the locking element 31 includes a kink-free flat support face 30 coacting with the locking face 32 and the inclined slide face and extending in parallel to the locking face 32. The transverse pin 46 is of a stretched shape to ensure that with a completely swung-out lever 21, the guidance of the locking element is maintained.

What is claimed is:

1. A wrench comprising a first arm carrying a first jaw, a second arm carrying a second jaw, first means for articulately connecting said first and second arms together, means for pivotally connecting said second jaw to said second arm, two stop means for limiting the pivotal movement of said second jaw relative to said second arm in two opposite directions of second jaw movement, a slider, second means for articulately connecting said slider to said second arm, means for movably connecting said slider to said first arm to thereby vary the distance between said first and second jaws, at least one of said stop means is carried by a slide member, a locking element constructed and arranged for moving said one stop means to an operative position thereof to contact said second jaw, and means for connecting said locking element to said second arm whereby relative movement of said second arm moves said locking element to a position freeing said slide member for movement to an inoperative position of said one stop means preventing contact thereof with said second jaw.

2. The wrench as defined in claim 1 wherein said locking element connecting means includes a connecting arm between said lockin ielement and said second arm.

3. The wrench as defined in claim 1 wherein said locking element includes a camming surface engageable against and movable along a surface of said slide member for moving said slide member one stop means to its operative position.

4. The wrench as defined in claim 1 including means for defining a support surface for supporting said locking element for movement therealong, said locking element includes a camming surface engageable against and movable along a cam follower surface of said slide member, and said cam follower surface and locking element supporting surface are generally parallel to each other.

5. The wrench as defined in claim 1 wherein said slide member includes a camming surface engageable against and movable relative to a surface of said locking element whereby said slide member one stop means is moved to its operative position.

6. The wrench as defined in claim 1 including means for defining a support surface for supporting said locking element for movement therealong, one of said locking element and slide member having one of a camming surface and a cam follower surface engageable against and moveable relative to each other, and said cam follower surface and locking element supporting surface are generally parallel to each other.

7. The wrench as defined in claim 1 wherein said locking element and slide member move along paths of travel which are generally normal to each other, said slide member is located between said second jaw and said locking element whereby clamping forces reacting against said second jaw are transmitted through said slide member to said locking element, and support surface means for opposing said reacting forces by supporting said locking element thereagainst.

8. The wrench as defined in claim 1 wherein said second articulate connecting means includes a first pin and slot connection, said second arm and second jaw connecting means includes a second pin and slot connection, and said slot of said first pin and slot connection extends toward said pin of said second pin and slot connection.

9. The wrench as defined in claim 1 wherein said second arm and second jaw connecting means includes a pin and slot connection, and said slot extends in a direction toward said second jaw.

10. The wrench as defined in claim 1 wherein said first articulate connecting means includes a slot in said first arm receiving a pin of said second arm, and another pin carried by said slider being received in said slot.

11. The wrench as defined in claim 1 wherein said first and second jaws have respective first and second groups of teeth of symmetric tooth profile defining generally planar working surfaces.

* * * * *

UNITED STATES PATENT AND TRADEMARK OFFICE

CERTIFICATE OF CORRECTION

PATENT NO. : 4,616,536

DATED : October 14, 1986

INVENTOR(S) : Fritz Knebel et al

It is certified that error appears in the above-identified patent and that said Letters Patent is hereby corrected as shown below:

In the "heading" under the caption "Assignee":

"Beler-Dowiday GmbH Werkzeug-Union"

should correctly read:

-- BELZER-DOWIDAT GmbH Werkzeug-Union --.

Signed and Sealed this

Third Day of February, 1987

*Attest:*

DONALD J. QUIGG

*Attesting Officer*

*Commissioner of Patents and Trademarks*